United States Patent [19]

Kjersem

[11] Patent Number: 4,774,418

[45] Date of Patent: Sep. 27, 1988

[54] METHOD FOR SETTING A TIMER CIRCUIT AND DEVICE IN SUCH A TIMER CIRCUIT

[75] Inventor: Arvid Kjersem, Kongsberg, Norway

[73] Assignee: A/S Kongsberg Vapenfabrikk, Kongsberg, Norway

[21] Appl. No.: 918,893

[22] Filed: Oct. 15, 1986

[30] Foreign Application Priority Data

Oct. 23, 1985 [NO] Norway ..... 854238

[51] Int. Cl.[4] ..... H01H 7/00; G08B 1/00; H03K 5/00

[52] U.S. Cl. ..... 307/141; 307/141.4; 307/141.8; 340/309.15; 340/309.4; 328/130.1

[58] Field of Search ..... 307/141, 141.4, 141.8; 340/309.15, 309.2–309.6, 638; 328/130.1

[56] References Cited

U.S. PATENT DOCUMENTS 4,035,661 7/1977 Carlson ..... 307/141

4,459,524 7/1984 Oota et al. ..... 307/141 X

*Primary Examiner*—William M. Shoop, Jr.

*Assistant Examiner*—Sharon D. Logan

*Attorney, Agent, or Firm*—Thomas R. Vigil

[57] ABSTRACT

The invention relates to a method and a device for setting a timer circuit, especially in a fuse (1*b*), there being used a setting unit (1*a*) for the transfer of setting signal to the timer circuit which is housed in the fuse (1*b*). For the purpose of simplifying the communication between the fuse (1*b*) and the fuse setting unit (1*a*), both as regards to avoiding previous calibration of the timer reference of the system, and as regards a reduction of the electro-mechanical contact connection between the fuse (1*b*) and the setting unit (1*a*) to a minimum, it has according to the invention been suggested that there are provided setting signals such that the time to which the timer circuit is to be set, is transferred from the setting unit (1*a*) to the fuse (1*b*) by pulse width modulation of the power supply voltage. The setting signal can then be transferred via only two contacts (K1, K2) on the surface of the fuse. The modulation can be to the fact of increasing the power supply voltage from a certain first value (V+) to a higher value (V++) and back to the first value (V+).

9 Claims, 3 Drawing Sheets

METHOD FOR SETTING A TIMER CIRCUIT AND DEVICE IN SUCH A TIMER CIRCUIT

BACKGROUND OF THE INVENTION

1. Field of the Art

The present invention relates to a method for setting a timer circuit, especially in a fuse, there being used a setting unit for transferring the setting signal to the timer circuit.

The invention also relates to a device in such a timer circuit.

2. Prior Art Statement

Usually, the communication between the setting unit and the timer circuit in a fuse will be implemented by means of electro-mechanical contact connections on the outer surface of the fuse. However, in connection with such galvanic connections the possibility for contact problems will be present and increase with the number of contact points. It is therefore desired to reduce the number of contact connections to a minimum.

Conventional electronic digital timer circuits or stop watches in a fuse are based on the principle that the timer circuit is set by means of a number of time related pulses which correspond to the set time (frequency setting) of the timer circuit. In order to achieve a sufficient accuracy the time references in the setting unit and the fuse must be synchronized, a fact which involves that one of the two units must be calibrated in relation to the other. This seems to be an unnecessary procedure, and it also complicates the communication between the programming unit in the timer circuit and the setting unit.

SUMMARY OF THE INVENTION

The object of the present invention is to provide a timer circuit for a fuse, in which the connection between the fuse and the setting unit is substantially simplified in relation to previous structures. Further, the invention has for an object to provide a timer circuit in which the setting thereof can take place without previous calibration of the time reference of the system, i.e. dependent of the clock oscillator which is included in the timer circuit.

The object of the present invention is achieved in a method of the type stated in the preamble, by which there are provided setting signals in the form of modulated power supply voltage.

By such a technique the setting signals are transferred to the fuse from the setting unit via two contacts on the surface of the fuse.

One of the contacts can then transfer electric power to the fuse, the power supply voltage at the same time having super-imposed thereonto the data corresponding to the setting value which is to be given to the timer circuit. As a setting signal or data signal there can for example be used a power supply voltage which exceeds a certain reference voltage.

Simultaneously with the modulation of the power supply voltage there takes place a corresponding current modulation of the current consumption of the fuse, and this current modulation or variation in the current consumption will be detected by the setting unit as control signals.

The other contact on the surface of the fuse connects the return conductor to a reference, for example metal, and with this two-contact solution it is possible to simultaneously transfer data signals both ways.

Calibration of the time reference in the system is avoided since the time to which it is desired to set the timer circuit, is transferred as a pulse which is pulse width modulated (period setting), the length of this pulse exactly corresponding to the set time devided by a known factor. As long as there is present a setting signal, which corresponds to the above mentioned pulse, a clock oscillator provided in the fuse will provide pulses which are counted by a counter and stored in a memory, the duration of the setting signal corresponding to a predetermined time setting devided by a known factor. As unknown number of internal clock pulses will thus be counted by the counter as long as the programming pulse remains. If the fuse resides in a launched projectile the counter will start its down counting immediately after launching. The internal clock frequency will then be devided by the known factor, such that the timer circuit now will obtain a running time corresponding to the correct time. This involves that the clock oscillator being used in the timer circuit, only needs to have a good short time stability, whereas long time stablility and variations from fuse to fuse can vary within wide limits.

Appropriately, the oscillator frequency can be stipulated on the basis of a predetermined resolution in the timer circuit and a division factor given by the setting unit.

A device in a timer circuit of the above type will comprise features which are more closely defined in the appended claims.

BRIEF DESCRIPTION OF THE DRAWINGS

The invention will now be further described, reference being had to the drawing which illustrates an embodiment of a timer circuit according to the invention.

DESCRIPTION OF PREFERRED EMBODIMENT

Firstly, the course of events in the setting phase or the programming phase will be discussed.

Figure 1:
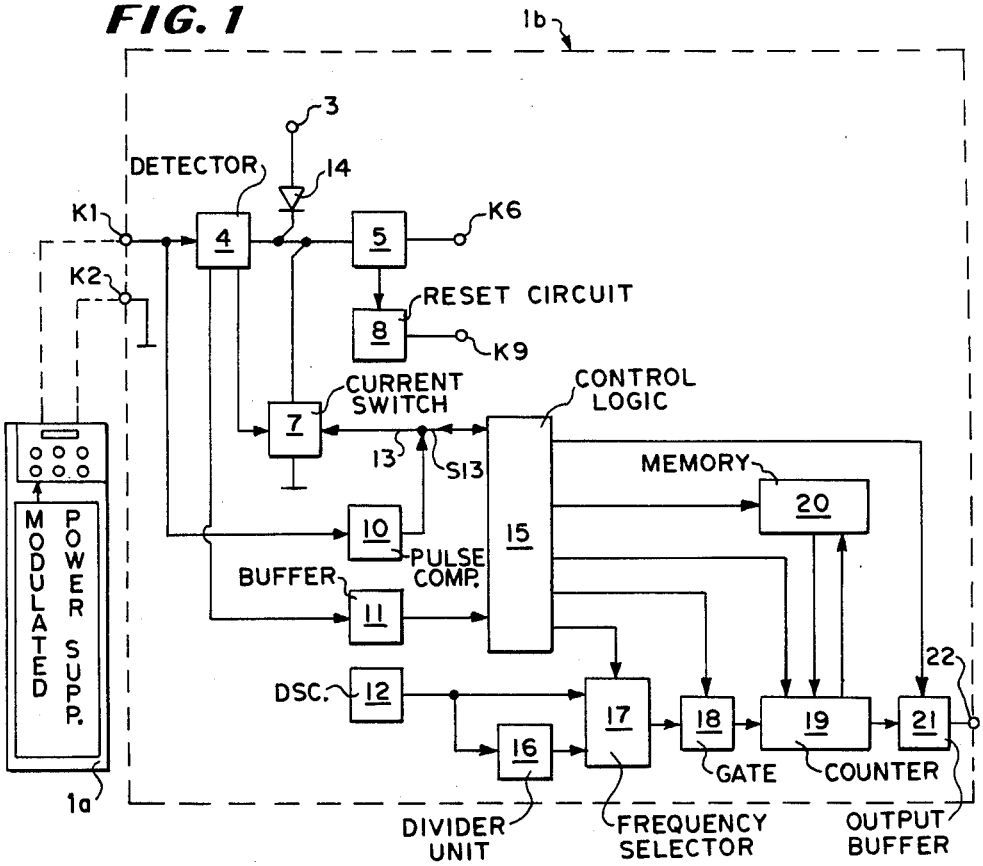
FIG. 1 is a block diagram of an embodiment of a timer circuit according to the present invention.

In FIG. 1 there is illustrated a setting unit 1*a* and a unit comprising a timer circuit, for example a fuse which is here illustrated by the dashed line 1*b*. The setting unit 1*a* is connected to the fuse 1*b* via the contracts K1 and K2, and after contact has been achieved between the setting unit 1*a* and the fuse 1*b*, the setting or the programming of a timer circuit in the fuse 1*b* can commence.

Figure 2:
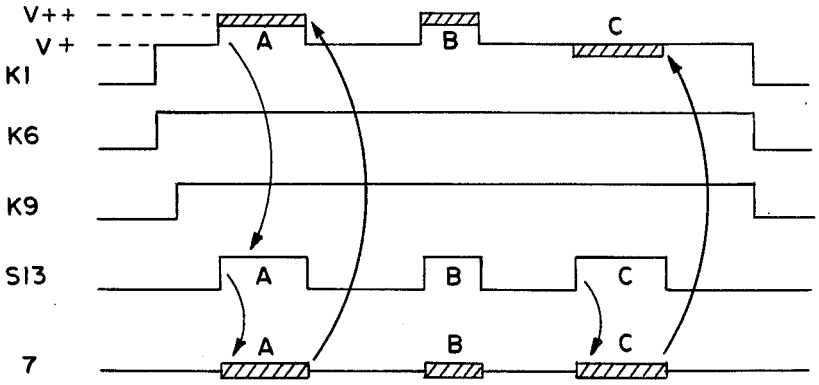
FIG. 2 illustrates the signal course at various positions in the block diagram of FIG. 1, in which hatched areas show the control signal which current modulates the power supply voltage.

In FIG. 2 there are illustrated various signal courses, and the line designated K1 for the upper signal course of FIG. 2 represents the signal communication between the setting unit 1*a* and the fuse 1*b*. This communication signal can appropriately be a modulated power supply voltage, a voltage being applied after having obtained contact between the setting unit 1*a* and the fuse 1*b*, such that the fuse 1*b* is supplied with a voltage V+ via the contact K1 in relation to the contact K2. The modulation of the supplied voltage V+ can be an increase of the voltage from V+ to a higher voltage V++, and back to V+. In other words there can as data signals be used a power supply voltage exceeding a certain reference voltage according to a given pattern.

The timer circuit which is housed by the fuse 1*b*, comprises a detector 4 which detects whether a switched on setting unit 1*a* is connected to the fuse 1*b* for supplying electric power to the fuse. The detector 4 can for example be constructed as a current detector detecting current above a certain value.

To the detector 4 there is connected a regulator 5 which regulates the supply voltage to the fuse, the internal non-regulated supply voltage being supplied via the contact 3 through a diode 14 and to the regulator 5. During the programming phase the internal voltage source will not be active, and there will then be no current from the contact 3. The diode 14 serves to prevent unnecessary current consumption from the setting unit 1*a* . The output from the regulator 5 will during normal operating conditions via the contact K6, supply all the electronic circuits which are connected to the time setting circuit in the fuse 1*b*. In the fuse 1*b* there is also included a feedback circuit 8 which via its terminal K9 will reset the electronic circuitry each time the regualtor 5 is switched on.

When the fuse 1*b* is supplied with voltage from the setting unit 1*a*, the detector 4 will, via a buffer 11, set the control logic 15 to a programming mode. At the same time a current switch 7 will be enabled to function when a signal from a pulse comparator 10 which is connector to the one input contact K1, and/or the control logic 15, is sent out to said current swtich 7.

When the supply voltage is switched on, an oscillator 12 will start oscillating. The oscillator 12 is appropriately a free running oscillator having a good short time stability. The output from the oscillator 12 is connected to a divider unit 16 and a frequency selector 17. The oscillator frequency is determined on the basis of a desired resolution on in the timer circuit and the dividing factor in the setting unit. A suitable resolution can for example be 0.1 second, and the dividing factor 1000 times, a fact which involves that the oscillator must operate with a frequency of minimum 10 kHz.

Because the control logic 15 is set to programming mode, the frequency selector 17, upon signal from the control logic 15, will be set to select an input signal direct from the oscillator 12.

When the timer circuit depicted in FIG. 1 is reset, it is made ready for setting of the time in question. The setting of the fuse, i.e. the timer circuit in the fuse, is in the disclosed proposal for solution implemented with two pulses A and B, as this appears from the signal diagram at the top of FIG. 2. Pulse A gives information about programmed time, the length of pulse A corresponding to the accurately set time divided with a known factor. If this factor is made equal to 1000, and if it is desired to set the timer circuit to 100 seconds, the pulse A will have a duration of 100 milliseconds. Pulse B is a write pulse, which entails that the set information is stored in a memory.

When the pulses A and B, respectively, are supplied to the fuse, they will be detected by the pulse comparator 10. A signal S13 from the pulse comparator 10 will then close the current switch 7 as long as the pulses remain. The additional current consumption which is caused by the current switch 7 at the output from the detector 4, will be registered by the setting unit 1*a*, and in this manner one will quickly get a response to whether larger parts of the electronic circuitry in the fuse operate satisfactorily.

During this first part of this programming phase the control logic 15 will be controlled by the signal S13 as a pace setter. The control logic 15 enables a gate 18 to be opened for clock pulses from the frequency selector 17 to a counter 19 as long as the pulse A exists. After the termination of pulse A, what has been stored in the counter 19 will be an unknown number of clock pulses which are proportional to the duaration of the set time in the fuse setting unit 1*a*.

The pulse B enables the control logic 15 to send a write pulse to the memory 20, and the contents of the counter 19 will then be stored in for example non-volatile transistor cells in the memory 20.

After the reading into the memory 20, the first part of the programming phase is terminated, and one will thereafter pass on to a checking phase. The control logic 15 will then be controlled by an internal pace maker which is tapped by the divider unit 16. The control logic 15 will then run through an inherent routine, the starting thereof being transferring the contents of the memory 20 to the counter 19. The counter 19 then starts its down counting, and the frequency selector 17 selects an input signal direct from the oscillator 12. The control logic opens the gate 18 to allow the counter 19 to start its down counting, there being provided a pulse C on the signal line S13. Pulse C will the have a duration corresponding to the time it takes to count down the counter 19 to zero. Pulse C on the signal line S13 will effect the current switch 7 to close as long as pulse C exists. Pulse C will be detected by the setting unit 1*a* and will compare the length of pulse A with pulse C. If the oscillator 12 has had a constant frequency throughout the complete programming phase, pulse C will have the same duration as pulse A, a fact which is checked by the setting unit 1*a*.

The control logic 15 and the counter 19 are both connected to an output buffer 21, and the control logic 15 will cater for no activity of the output buffer 21 during the programming phase. After comparison and control of the pulses A and C, the programming phase is completed, and the setting unit 1*a* will switch off the power supply to the fuse 1*b*, whereafter the setting unit is removed from the fuse.

If the above mentioned timer circuit resides in a projectile, the trajectory thereof will commence at the moment of discharge, the internal supply voltage being supplied via the contact 3. The regulator 5 will then supply the electronic circuitry with electric power via the output K6, whereas the resetting circuit 8 will reset the electronic circuitry, and the oscillator 12 will start oscillating.

The detector 4 will now register that no fuse setting unit is connected to the fuse and will set the control logic 15 to trajectory mode via the buffer 11. The control logic 15 adjusts the frequency selector 17 to select clock pulses from the divider unit in the setting unit 16. This involves that the pulse length which the data in the memory 20 represent, now will be multiplied by the same factor which was used in the fuse setting unit during this programming of the timer circuit. If the oscillator frequency from the oscillator 12 is the same as during the programming phase, the running time of the timer circuit will correspond to the time being set on the setting unit. The control logic 15 will immediately after the resetting of the electronic circuitry run through an inherent routine, it now being controlled by the same internal pace maker as during the checking part of the programming phase. What wil happen now, is that the contents of the memory 20 in first instance will be transferred to the counter 19 which has been set to down counting, whereafter the gate 18 will open and the counter 19 commence to count down. The output buffer 21 will not be enabled to received signal from the counter 19. When the timer circuit has run out in the counter 19 has counted down to zero, it will output a signal to the output buffer 21. The output 22 will now be activated and the trajectory phase terminated.

It is to be understood that the above described embodiment only illustrates an arbitrary proposal for solution, only one counter and one memory being used therein. However, it is of course possible to include a further memory and/or counter for achieving av greater flexibility and security. The counters and/or memories can either be programmed simultaneously with pulse A and pulse B, or they can be programmed in series by means of a new pulse from the setting unit, this new pulse appearing between pulse A and B and giving information to the counter and/or memory number 2.

It can often be desired to have a fixed time which has to run out before the output buffer 21 is activated. If this is implemented as a hardware programmed counter, it will constitute a fair contribution to the safety if the memory 20 with non-volatile transistor cells should possibly fail. The accuracy of such a counter will, however, be dependent on the long time stability of the oscillator 12.

It is also possible to set the timer circuit to various modes. This can be done in that the setting unit supplies to the fuse a new pulse after pulse A. The control logic 15 will compare the length of this pulse with the pulse duration of the internal time reference in the fuse by tapping a signal from the down counter 16 at an appropriate location. The result can be stored in separate 1-bits non-volatile transistor cells when the write pulse B is supplied.

By an appropriate design of the control logic 15 it is possible to read all the programmed times and modes of the setting of the fuse during the checking part of the programming phase. It is also possible to read the programmed times and modes without a previous setting of the fuse.

It is to be understood that the principle of setting the timer circuit by means of pulse width modulation (period setting) also can be used where the setting signal is transferred by means of electro magnetism, radio waves or light.

Combinations of variations in solution can render a very versatile timer circuit. The timer circuit can operate alone or in a timer fuse or be combined with proximity and impact functions.

There are two types of modulation.

1. In the setting unit the program source or modulator modulates the power supply voltage from V+ to V++ volts.

2. In the timer a current switch (7) modulates the current consumption of the timer whenever programming pulses are transferred from the setting unit or control signal (pulses) transferred from the timer to the setting unit.

Figure 3:
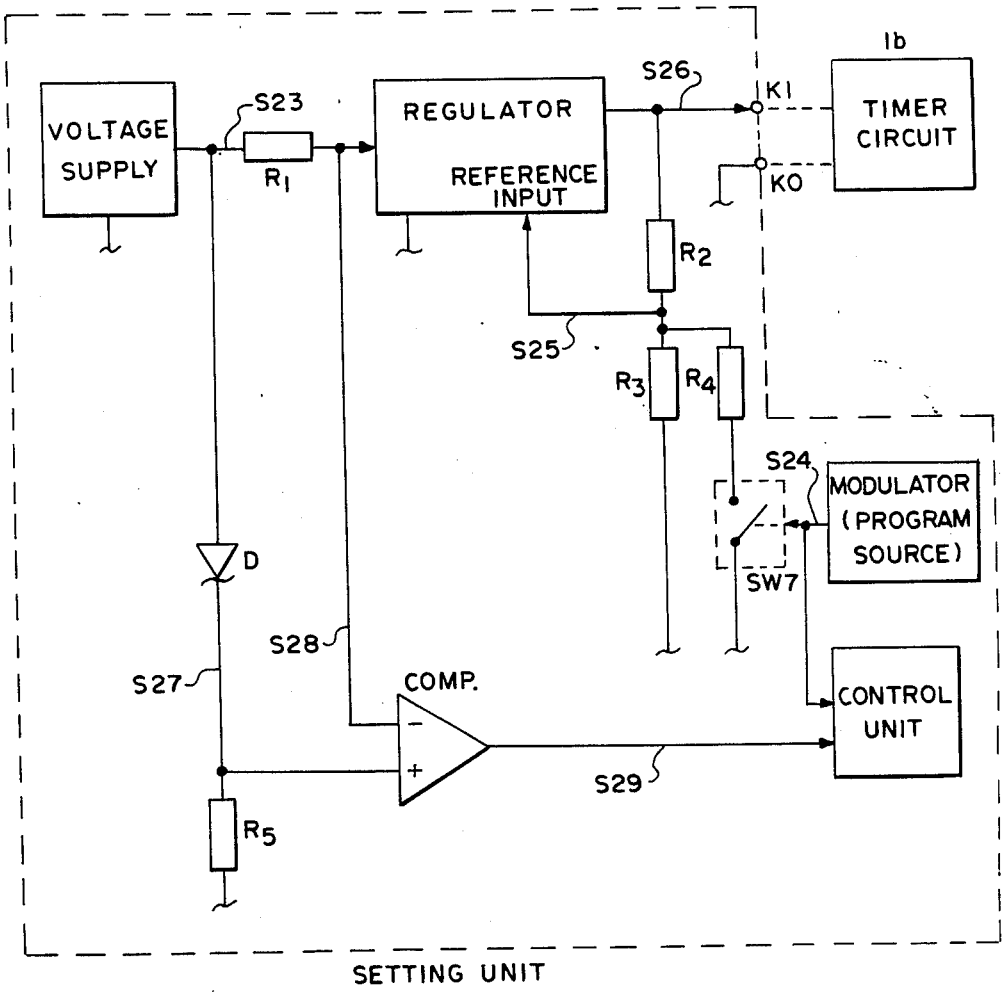
FIG. 3 is a block diagram of a setting unit.
Figure 4:
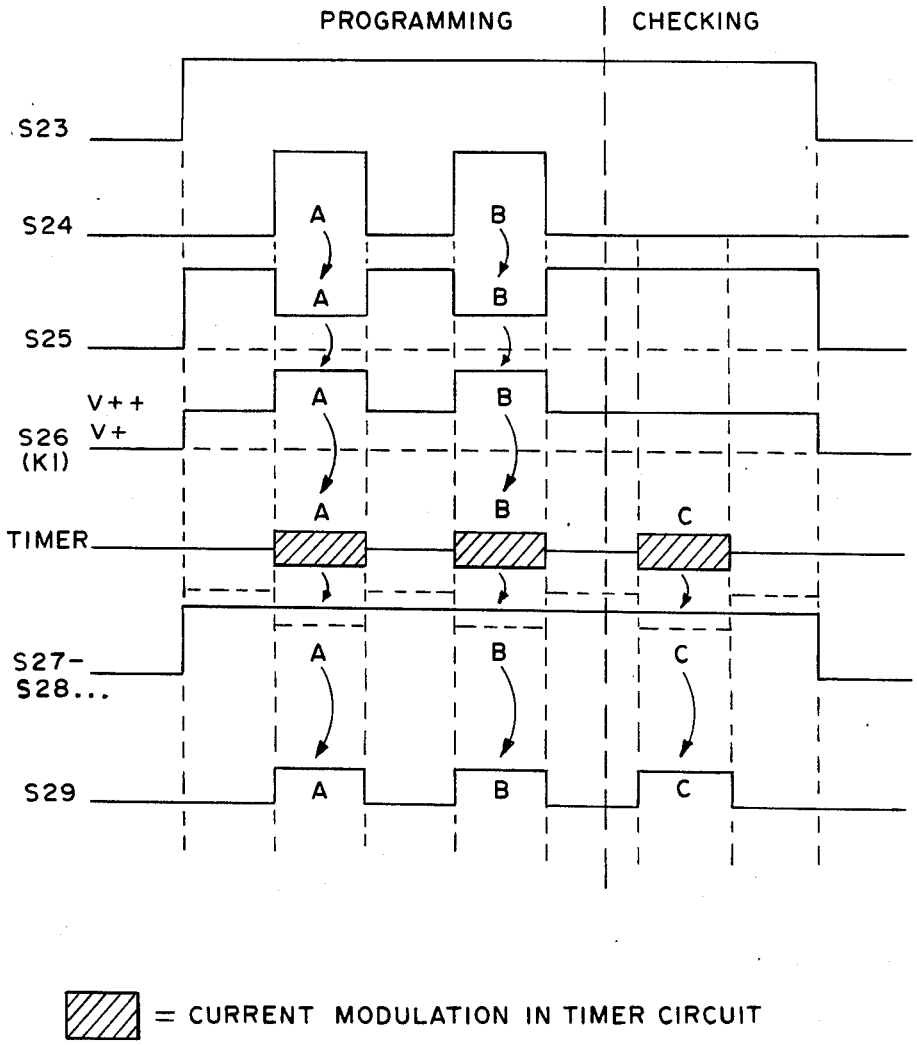
FIG. 4 illustrates the timing logic for the setting unit of FIG. 3.

An example of the setting unit 1*a* is illustrated in FIG. 3. and the timing logic for same is illustrated in FIG. 4.

The modulated power supply voltage is produced by changing the reference input of the regulator. Before programming starts, the output of the modulator is low and switch, SW1, is not connected. The output voltage of the regulator is then fixed by $R_2$ and $R_3$ to V+ volts.

When the modulator applies pulse A and B, (see FIG. 4), the switch SW1, will close and connect the resistor, R4, in parallel with $R_3$ and the regulator output voltage will increase to V++ volts. The regulator has to be designed such that the current consumption of the regulator has to be designed such that the current consumption of the regulator itself will not change when the output voltage changes between V+ and V++.

$R_1$ is the current sensing resistor. When the fuse is connected, but no programming takes place, the voltage drop across R, is less than the voltage drop across the diode D, and the output of the comparator is low.

When programming pulses, V++, is applied to the timer, or when the timer responds with control pulses, the supply voltage will be current modulated by the by the current switch 7 in the timer.

This additional current consumption that the current switch 7 causes will result in an additional voltage drop of over $R_1$, which is greater than the diode voltage of diode D.

The output of the comparator will change to high and this will be detected by the control unit.

In this manner, the control unit will, during programming, compare the setting pulses from the modulator in the setting unit with the control pulses from the modulator in the setting unit with the control pulses from the timer, and during the checking phase, it will compare the control pulses with the previously transmitted setting pulses. Note that the control unit must have a memory for storing setting pulses.

I claim:

1. A method for setting a timer circuit employing a setting unit which is separable from said timing circuit and which, supplies a modulated power signal switched between a reference voltage V+ and a supply voltage V++, said timer circuit including a signal contact, a detector, a pulse comparator, an oscillator, a counter, control logic, and a memory, all operatively connected to detect the power signal, and store a pulse count representing the time to be set, said method comprising the step of:

connecting said setting unit to said signal contact;

detecting the connection of said setting unit to said signal contact with said detector;

generating a detection signal with said detector, while said connection is established;

generating clock pulses with said oscillator, while said detection signal is present;

modulating said power signal by generating a timing pulse in said setting unit by switching from said reference voltage to said supply voltage and to said reference voltage from said supply voltage, the duration of said timing pulse being a timing pulse duration in a predetermined ratio to the desired time to be set;

enabling said pulse counter to count clock pulses while said timing pulse exists; and storing in memory the pulse count counted in said pulse counter when said pulse counter is enabled after said timing pulse.

2. The method of claim 1 wherein:

said timing circuit further includes a current switch operatively connected to said control logic, said pulse comparator and said detector; and said method further includes providing a current switch signal when said counter is counting; and counting said stored clock pulses after they are stored.

3. The method of claim 2 including the steps of:

supplementing the current switch signal with an increase in current consumption of the fuse circuit as long as current switch signals are present; and sensing increases in current consumption at said signal contact whereby said setting unit detects the increases in current consumption of the fuse circuit as control signals.

4. A fuse timing method for setting a fuse time in a fuse timer circuit to a predetermined resolution factor to ensure timing accuracy employing a setting unit which is separable from said timing unit and which supplies a modulated power signal switched between a reference voltage V+ and a supply voltage V++, said timer circuit including a signal contact, a detector, a pulse comparator, an oscillator oscillating at a constant timing frequency near a resolution frequency for a time at least slightly in excess of any fuse time to be set, a counter, control logic, and a memory, all operatively connected to detect the power signal, and store a pulse count representing the fuse time to be set, said fuse timer activating said fuse after the fuse time following the firing of a projectile containing said fuse and fuse timer, said method comprising the steps of:

connecting said setting unit to said signal contact;

detecting the connection of said setting unit to said signal contact with said detector;

generating a detection signal with said detector, while said connection is established;

generating clock pulses with said oscillator, while said detection signal is present;

modulating said power signal by generating a timing pulse in said setting unit by switching from said reference voltage to said supply voltage and to said reference voltage from said supply voltage, the duration of said timing pulse being a timing pulse duration equal to a division factor, being the resolution factor times the resolution frequency, dividing the desired time to be set;

enabling said pulse counter to count clock pulses while said timing pulse exists; and storing in memory the pulse count counted in said pulse counter when said pulse counter is enabled after said timing pulse.

5. The method of claim 4 further comprising the step of modulating said power signal by generating a set pulse by switching from said reference voltage to said supply voltage and to said reference voltage from said supply voltage after sid timing pulse, said set pulse causing the step of storing in memory.

6. the method of claim 4 further comprising the step of modulating said power signal by generating a mode pulse in said setting unit by switching from said reference voltage to said supply voltage and to said reference voltage from said supply voltage, said mode pulse selecting one or more programmed modes of operation for the timer circuit.

7. A projectile fuse timing circuit within a projectile responsive to a power modulated signal switched between a reference voltage V+ and a supply voltage V++ supplied by a setting unit separable from said timing circuit, said circuit comprising:

no more than two contacts for receiving the power modulated signal including a signal contact;

a detector operatively connected to said signal contact which generates a pulse signal as long as the voltage at the signal contact is above the reference voltage;

control logic means operatively connected to said detector for receiving said power modulated signal, and to said detector (via a buffer circuit) for receiving the detector signal and then generating an enable signal which produces an oscillating signal when the enable signal is present;

an oscillator which is operatively connected to said control logic means for receiving the oscillator signal and oscillating at a constant timing frequency near a resolution frequency when said oscillator signal is present to produce clock pulses and which is capable of oscillating at the constant timing frequency for at least a time slightly in excess of any fuse time to be set;

a pulse comparator operatively connected to said signal contact and to said control logic means and operable to generate a pulse signal when the voltage at the signal contact is at least the supply voltage;

a counter operatively connected to said control logic means and said oscillator, said counter counting clock pulses generated by said oscillator when an enable signal is present;

a memory operatively connected to said control logic means and to said counter for receiving and storing the pulse count of said counter, said pulse count being representative of the time to be set for said fuse to be activated following the firing of the projectile.

8. The projectile fuse timing circuit of claim 7;

wherein said timing circuit has a desired accuracy equal to a predetermined resolution factor, and said setting unit produces a timing pulse having a timing pulse duration, the timing pulse duration being equal to the time to be set divided by a dividing factor which is equal to the resolution factor times the resolution frequency, said control logic producing a trajectory signal only after the firing of the projectile, and said timing circuit further comprising a divider operatively connected to said oscillator which only transmits every dividing factor clock pulse;

a frequency selector operatively connected to said oscillator, said divider, said counter and said control logic for selectively counting all clock pulses and divided clock pulses, all clock pulses being counted when the trajectory signal is not present and only divided clock pulses being counted when the trajectory signal is present.

9. The projectile fuse timing circuit of claim 7 further including:

a current switch which is operatively connected to said control logic, said pulse comparator and said detector and which is under the selective control of said pulse comparator and control logic, said pulse comparator or control logic providing a current switch signal sensible at said signal contact when said counter is counting, said signal current switch signal being implemented as an increase in the current consumption of the fuse circuit or a current modulation thereof, which increases in current consumption are detected by the setting unit as control signals.

* * * * *

UNITED STATES PATENT AND TRADEMARK OFFICE

CERTIFICATE OF CORRECTION

PATENT NO. : 4,774,418

DATED : September 27, 1988

INVENTOR(S) : Arvid Kjersem

It is certified that error appears in the above-identified patent and that said Letters Patent is hereby corrected as shown below:

On the title page,

"(73) Assignee: A/S Kongsberk Vapenfabrikk" should be --(73) Assignee: Norsk Forsvarstenknologi A/S,--;

In the Abstract, (57), line 7, "timer" should be --time--;

Column 1, line 45, "dependent" should be --independent--;

" 2, line 13, "devided" should be --divided--;

" 2, line 14, "As" should be --An--;

" 2, line 19, "devided" should be --divided--;

" 2, " 54-55, "contracts" should be --contacts--;

" 3, " 31, "connector" should be --connected--;

" 4, " 28, "the" should be --then--; (2nd occurrence)

" 4, " 58, "Unit in the setting unit 16" should be --unit 16.--;

" 4, " 62, "this" should be --the--;

" 5, " 2, "wil" should be--will--;

" 5, " 7, "not" should be --now--;

" 5, " 7, "received" should be --receive--;

" 5, " 8, "in the" should be --in that the--;

" 5, " 16, "av" should be --a--;

" 5, " 41, "an.appropriate" should be --an appropriate--;

" 5, " 66, "3.and" should be --3 and--;

UNITED STATES PATENT AND TRADEMARK OFFICE

CERTIFICATE OF CORRECTION

PATENT NO. : 4,774,418

DATED : September 27, 1988

INVENTOR(S) : Arvid Kjersem

It is certified that error appears in the above-identified patent and that said Letters Patent is hereby corrected as shown below:

Column 6, Lines 9-10, delete "has to be designed such that the current consumption of the regulator:'

Column 6, Line 18, delete "by the"; (first occurrence)

" 6, Line 26, "unit will" should be --unit in the setting unit will--;

" 6, Line 32, "the" should be --this--;

" 6, Line 44, "step" should be --steps--:

" 7, " 53, "sid" should be --said--; and

" 8, " 6, "detector for: should be --detector (via a pulse comparator) for--.

Signed and Sealed this

Thirty-first Day of July, 1990

*Attest:*

*Attesting Officer*

HARRY F. MANBECK, JR.

*Commissioner of Patents and Trademarks*